US006248295B1

(12) United States Patent
Petrek

(10) Patent No.: US 6,248,295 B1
(45) Date of Patent: Jun. 19, 2001

(54) PIPETTE WITH IMPROVED PIPETTE TIP AND MOUNTING SHAFT COMBINATION

(75) Inventor: James S. Petrek, Danville, CA (US)

(73) Assignee: Rainin Instrument Co., Inc., Emeryville, CA (US)

( * ) Notice: Subject to any disclaimer, the term of this patent is extended or adjusted under 35 U.S.C. 154(b) by 0 days.

(21) Appl. No.: 09/234,195

(22) Filed: Jan. 20, 1999

Related U.S. Application Data

(63) Continuation-in-part of application No. 09/188,032, filed on Nov. 6, 1998, now abandoned.

(51) Int. Cl.[7] ..... B01L 3/02
(52) U.S. Cl. ..... 422/100; 73/864.01; 73/864.14
(58) Field of Search ..... 422/99, 100; 73/864.01, 73/876.14

(56) References Cited

U.S. PATENT DOCUMENTS 5,200,151 * 4/1993 Long .
5,232,669 * 8/1993 Pardinas .

* cited by examiner

*Primary Examiner*—Jan Ludlow
(74) *Attorney, Agent, or Firm*—Robert R. Meads

(57) ABSTRACT

An air displacement pipette having axially spaced annular sealing and frusto-conical lateral support zones and regions on the pipette's mounting shaft and tip, respectively, in combination with structure for insuring uniform depth of mounting shaft penetration into the pipette tip to maintain uniform tip interference with the mounting shaft as successive tips are mounted on and ejected from the mounting shaft whereby the pipette tip is easily and firmly mountable on and ejectable from the pipette tip mounting shaft by the application of reduced user generated axial forces.

11 Claims, 3 Drawing Sheets

PIPETTE WITH IMPROVED PIPETTE TIP AND MOUNTING SHAFT COMBINATION

RELATED APPLICATION

This application is a continuation-in-part application of U.S. patent application Ser. No. 09/188,032 filed Nov. 6, 1998, now abandoned assigned to the same assignee as the this patent application.

FIELD OF INVENTION

The present invention relates to improvements in pipettes and, more particularly, to air displacement pipettes including a unique pipette tip tailored to the distal end of the pipette's tip mounting shaft such that the tip is easily insertable by a pipette user onto the mounting shaft to a fluid tight position in which the tip is secured against undesired lateral rocking on or displacement from the shaft and, after use, is easily ejectable from the shaft by the pipette user.

BACKGROUND OF INVENTION

During the development of the unique pipette tip described in U.S. patent application Ser. No. 09/188,030, filed Nov. 6, 1998 now U.S. Pat. No. 6,197,259 and entitled "Easy Eject Pipette Tip" and the development of the novel pipette tip and tip mounting shaft combination described in U.S. patent application Ser. No. 09/188,031, filed Nov. 6, 1998 now U.S. Pat. No. 6,168,761 and entitled "Pipette With Improved Pipette Tip and Mounting Shaft", both applications being incorporated herein by this reference, a special pipette tip and mounting shaft combination was discovered which provides for easier tip mounting, improved lateral tip stability and easier tip ejection than standard commercially available pipette tip and tip/shaft combinations. A brief description of the newly discovered pipette tip and mounting shaft combination is as follows.

SUMMARY OF INVENTION

The present invention incorporates in an air displacement pipette the concept of similar frusto-conical distal and proximal end portions on a pipette tip mounting shaft and pipette tip respectively. The frusto-conical distal and proximal end portions have substantially parallel inwardly and downwardly tapering surfaces incorporating axially spaced annular sealing and lateral support zones and regions on the mounting shaft and tip, respectively. Further, the present invention incorporates cooperative means on the shaft and tip for insuring uniform depth of mounting shaft penetration into the pipette tip to maintain uniform tip interference with the mounting shaft as successive tips are mounted on and ejected from the mounting shaft.

In particular, the present invention comprises a combination of a pipette tip mounting shaft and pipette tip in an air displacement pipette. The mounting shaft comprises an axially elongated body including a frusto-conical distal end portion having an axially tapering outer surface with annular axially spaced outer surface regions defining an annular sealing zone and an axially tapering annular lateral support zone. The pipette tip is an elongated tube comprising an open frusto-conical proximal end portion, an open conical distal end and annular axially spaced inner surface regions on the axially tapering frusto-conical inner surface of the proximal end portion defining an annular sealing region and an axially tapering annular lateral support region. The axial tapering of the mounting shaft and pipette tip are one and one-half degrees or more from the longitudinal axis of the shaft and preferably between one and one-half and five or six degrees. The outer diameter of the annular sealing zone on the mounting shaft is slightly greater than the inner diameter of the annular sealing region on the pipette tip and the sidewall of the tip in the area of the annular sealing region is sufficiently thin that the annular sealing region expands slightly to form an interference fit and air tight seal between the mounting shaft and the pipette tip when the sealing zone penetrates the sealing region. The axial spacing of the sealing and support zones is substantially equal to the axial spacing of the sealing and support regions. Also, the outer diameters of the mounting shaft in the axially tapering lateral support zone are slightly less than or substantially equal to corresponding inner diameters of the proximal end portion of the tip in at least some circumferential portions of the axially tapering lateral support region. This allows for some minimal contact between the support zone and region without creating a secondary air tight seal which would result in an undesired increase in the axial forces required to mount and eject the pipette on and from the shaft. With such a structural configuration, as the sealing zone penetrates the sealing region, the support region receives the support zone and provides lateral support therefor which prevents transverse rocking of the pipette tip on the mounting shaft as might otherwise occur during touching off of the pipette tip and an accompanying undesired dislodging of the tip from the shaft.

Further, the preferred embodiment of the present invention includes the aforementioned controlled interference air tight fit and mating annular lateral support zone and region as well as cooperative means on the pipette and pipette tip for limiting the axial travel of the tip on the mounting shaft. This insures uniform depth of mounting shaft penetration into the pipette tip to maintain uniform the desired tip interference with the mounting shaft as successive tips are mounted on and ejected from the mounting shaft.

Still further, for pipette tip and shaft combinations wherein the interference fit between the sealing zone and region is about 0.075 mm to about 0.2 mm and the wall thickness of the pipette tip in the sealing region is between 0.2 and 0.5 mm, it has been discovered that the desired minimal tip mounting and ejection forces associated with the present invention still may be achieved and the lateral stability of the tip on the shaft further enhanced when there is a small interference fit between the support region and zone. The small interference is provided by the lateral support region of the tip having an inner diameter which is slightly less than the outer diameter of the lateral support zone of the shaft, eg. less than 0.075 mm. Further, when the shaft and tip are concentric and substantially circular in the support zone and region, a secondary air tight seal may be created between the support zone and region without creating an undesired increase in the axial forces required to mount and eject the tip on and from the shaft.

DETAILED DESCRIPTION OF INVENTION

Figure 1:
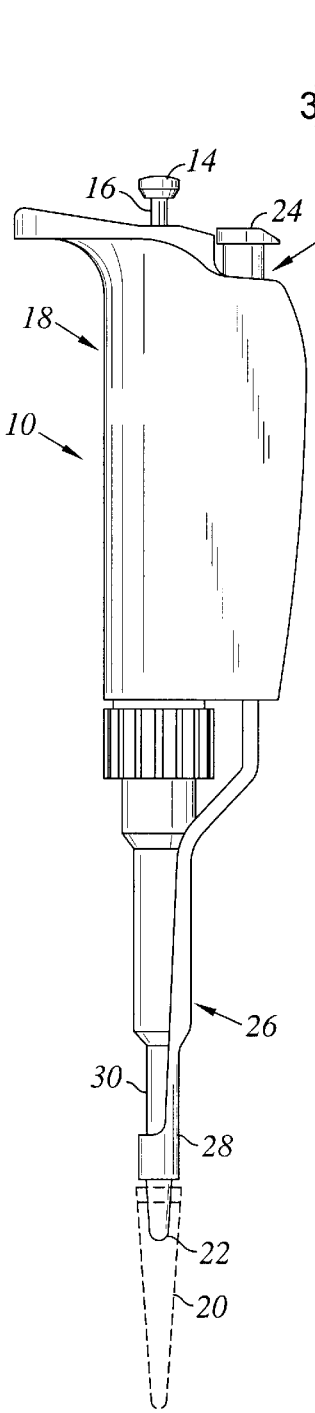
FIG. 1 is a side view of a standard manual pipette having a pipette tip mounted on a mounting shaft adjacent a lower end of a tip ejector mechanism of the pipette.

FIG. 1 illustrates a standard manual pipette resembling the PIPETMAN pipette sold exclusively in the United States by the Rainin Instrument Co. Inc., assignee of the present invention. The manual pipette is designated in FIG. 1 by the number 10 and includes a pipette tip ejector mechanism 12 described in U.S. Pat. No. 3,991,617 issued Nov. 16, 1976, which is incorporated herein by this reference.

The pipette 10 comprises a push button 14 connected by a rod 16 to a piston (not shown) located in the body or housing 18 of the pipette. The push button 14 may be depressed by a user exerting a downward force on the push button to cause downward movement of the piston of the pipette. When the push button 14 is released, a quantity of liquid to be sampled is sucked into a disposable pipette tip 20 releasably secured to a lower end of a pipette tip mounting shaft 22 of the pipette. The sample then may be transferred into another vessel by once more exerting a downward force on the push button 14. After such use, it is common practice to eject the pipette tip 20 from the mounting shaft 22 and replace it with a new pipette tip for repeated operation of the pipette 10 in aspirating and dispensing a new sample fluid.

The pipette tip mechanism ejector 12 is employed to eject the tip 20 from the mounting shaft 22. In this respect, the mechanism 12 comprises a push button 24 connected to a rod located in a passage (not shown) provided in an upper part of the hand holdable housing 18 of the pipette 10. The passage and rod are arranged so as to be able to impart to the rod a movement of translation parallel to an axis of the pipette in opposition to a spring (not shown) normally urging the rod in an upward position. A removable tip ejector member or arm 26 including a tubular upper end extends from a lower end of the rod and from the rod follows the general exterior contour of the housing 18 of the pipette to terminate in a sleeve 28. The sleeve 28 encircles a conical lower end 30 of the pipette tip mounting shaft 22 which tightly receives the upper end of the disposable pipette tip 20. To eject the pipette tip 20 from the lower end of the mounting shaft 22, a user grips the pipette housing 18 and using his or her thumb presses downward on the push button 24. The downward force on the push button is translated by the rod to the tip ejector arm 26 and hence to the sleeve 28 which presses down on an upper end of the pipette tip. When the downward force transferred by the sleeve 28 exceeds the friction between the pipette tip 20 and the mounting shaft 22, the pipette tip is propelled from the mounting shaft. Upon a release of the push button 24, the spring returns the tip ejector mechanism 12 to its normal position with the sleeve spaced slightly from the upper end of a replacement pipette tip which is inserted onto the mounting shaft 22 readying the pipette 10 for its next aspiration and dispensing operation.

Figure 2:
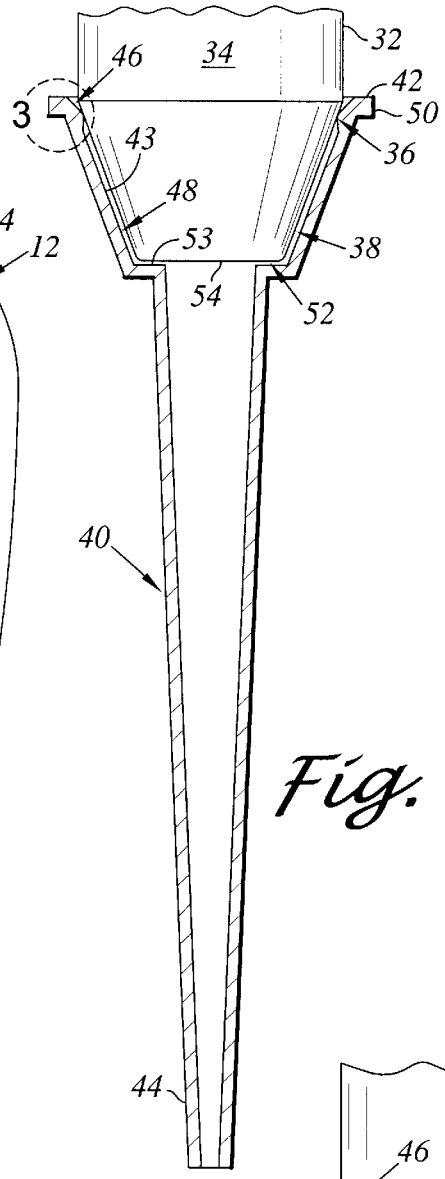
FIG. 2 is a cross sectional side view of one embodiment of the pipette tip and mounting shaft combination of the present invention showing the fluid tight seal between the sealing region and sealing zone, the mating relationship of the lateral support region and zone and a preferred embodiment of the cooperative means including a shoulder on the pipette tip for limiting mounting shaft penetration into the tip.

A preferred embodiment of the structure of the pipette tip and mounting shaft combination of the present invention is depicted in FIG. 2. As there illustrated, the mounting shaft 32 comprises an axially elongated body including a frusto-conical distal end portion 34 having an outer surface which tapers axially inwardly from a main or upper portion of the shaft. The axially tapering outer surface of the distal end portion 34 comprises annular axially spaced outer surface regions defining an annular sealing zone 36 adjacent an upper end of the distal end 34 and an annular axially and downwardly and inwardly tapering lateral support zone 38 on the distal end portion 34 near the lower end of the mounting shaft 32.

The pipette tip is represented by the numeral 40 and is an elongated plastic tube comprising an open frusto-conical proximal end portion 42, an open conical distal end portion 44 and annular and axially spaced inner surface regions on the axially downwardly and inwardly tapering inner surface 43 of the proximal end portion 42 defining an annular sealing region 46 and an axially tapering annular lateral support region 48 for mating with the sealing and support zones 36 and 38 respectively, on the mounting shaft 32. As illustrated, the frusto-conical inner surface of the proximal end portion 42 of the tip 40 is similar to and slightly larger than the frusto-conical outer surface of the distal end portion 34 of the shaft 32. Also, in any axial vertical plane, the outer surface of the frusto-conical distal end portion of the shaft 32 is substantially parallel to the inner frusto-conical surface of the proximal end portion 42 of the tip 40. As used herein, "substantially parallel" means that the outer surface of the axially tapering outer surface of the distal end portion 34 is within one and one-half degrees of the axial taper of the inner surface 43 of the proximal end portion 42 of the tip 40.

Figure 3:
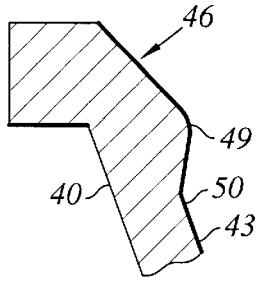
FIG. 3 is an enlarged fragmentary section side view of the sealing region within the circle 3 for the pipette tip of FIG. 2.

FIG. 3 illustrates in enlarged detail a preferred embodiment of the sealing region 46 and comprises the portion of the pipette tip 40 of FIG. 2 within the circle 3. As shown, the sealing region 46 is formed by an inwardly extending substantially V-shaped bead 49 extending radially inward from the sidewall 50 of the pipette tip 40. The innermost surface of the bead 49 forms a very narrow annular sealing band or line for engaging the sealing zone 36 of the pipette tip mounting shaft 32 to form the previously described air-tight seal between the tip and mounting shaft.

As illustrated in FIG. 2, the outer diameter of the annular sealing zone 36 is slightly greater than the inner diameter of the annular sealing region 46 on the pipette tip 40 and the sidewall 50 of the tip in the area of the annular sealing region 46 is sufficiently thin that the annular sealing region expands slightly to form an interference fit and air tight seal between the mounting shaft 32 and the pipette tip 40 when the sealing zone 36 penetrates the sealing region 46. In practice, it has been found that the desired interference fit is formed when the difference in the outer diameter of the annular sealing zone and the inner diameter of the annular sealing region is at least 0.075 millimeters (mm). Further, it has been found that in practice that the wall thickness of the pipette tip in the area of the sealing region 46 is preferably between 0.20 and 0.50 mm.

Also as illustrated in FIG. 2, the axial spacing of the sealing and support zones is substantially equal to the axial spacing of the sealing and support regions. Also, the outer diameters of the shaft 32 within the axially tapering lateral support zone 38 are slightly less than or substantially equal to corresponding inner diameters of the proximal end portion within at least some circumferential portions of the axially tapering lateral support region. This allows for some minimal contact between the support zone and region without creating a secondary air tight seal which would result in an undesired increase in the axial forces required to mount and eject the pipette tip on and from the shaft. With such a structural configuration, as the sealing zone 36 penetrates the sealing region 46, the support region 48 receives the support zone 38 and provides lateral support therefor which prevents transverse rocking of the pipette tip 40 on the mounting shaft 32 as might otherwise occur during "touching off" of the pipette tip and an accompanying undesired dislodging of the tip from the shaft. In these regards, it is preferred that the axial spacing of the mating lateral support zone 38 and region 48 from the sealing zone and region (36, 46) is substantially equal to the inner diameter of the pipette tip 40 in the portion of the support region engaging the support zone. Such a length relationship provides excellent lateral stability for the pipette tip 40 on the mounting shaft 32.

Further, as illustrated in FIG. 2, the present invention includes cooperative means 52 on the pipette of the present invention and the pipette tip 40 for limiting the axial travel of the tip on the mounting shaft 32. This insures uniform depth of mounting shaft penetration into the pipette tip to maintain uniform tip interference with the mounting shaft as successive tips are mounted on and ejected from the mounting shaft. In the embodiment illustrated in FIG. 2, such cooperative means 52 comprises an annular, upwardly facing, inwardly directed shoulder 53 on the inner surface of the pipette tip 40 immediately adjacent the lateral support region 48. The shoulder 53 is designed such that an upper surface thereof engages a downwardly facing surface such as the bottom 54 of the distal end 34 of the mounting shaft 32 at an outer circumferential portion thereof.

Figure 4:
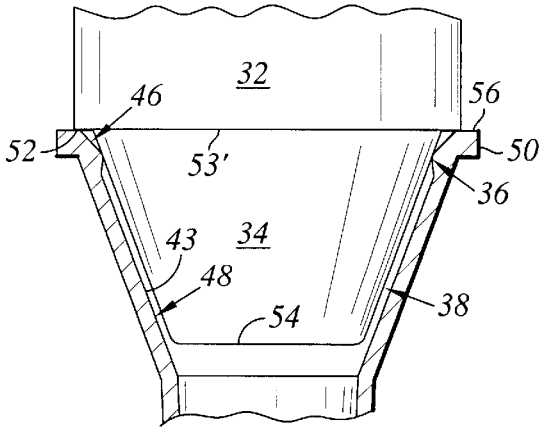
FIG. 4 is an enlarged fragmentary side view of an upper portion of the pipette tip and mounting shaft combination similar to FIG. 2 showing a first alternative embodiment of the cooperative means including a shoulder on the mounting shaft for limiting mounting shaft penetration into the tip.

An alternate embodiment of the cooperative means 52 is depicted in FIG. 4 as comprising an outwardly directed downwardly facing annular shoulder 53' on the pipette tip mounting shaft 32 which upon insertion of the shaft into the open proximal 42 of the tip engages the upper annular edge 56 of the tip to halt further penetration of the shaft into the tip.

Figure 5:
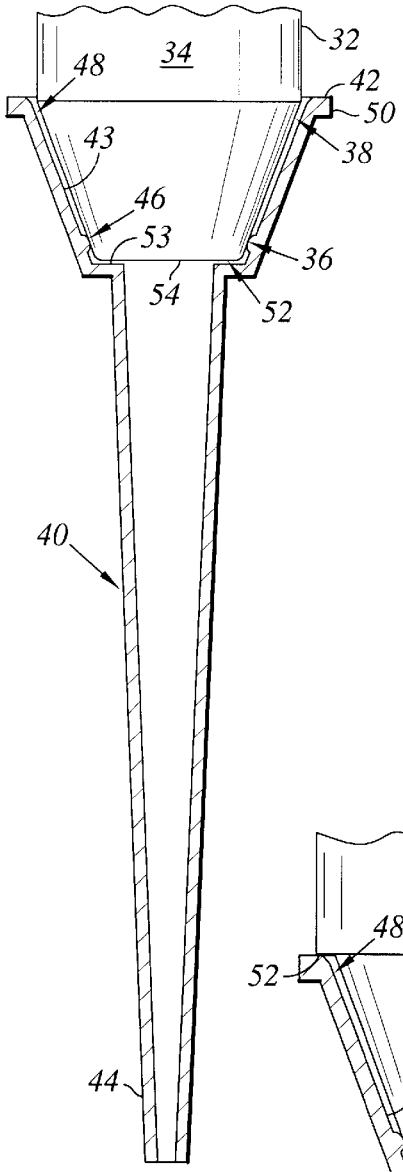
FIG. 5 resembles FIG. 2 and shows an embodiment where the axial location of the sealing zone and region is reversed relative to the axial location of the support zone and region shown in FIG. 2.
Figure 6:
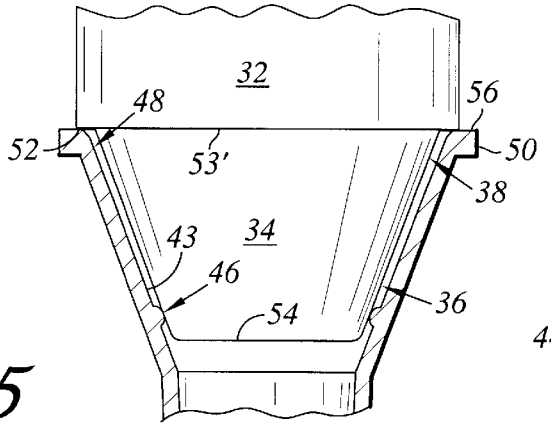
FIG. 6 resembles FIG. 4 and shows an embodiment where the axial location of the sealing zone and region is reversed relative to the axial location of the support zone and region shown in FIG. 4.
Figure 7:
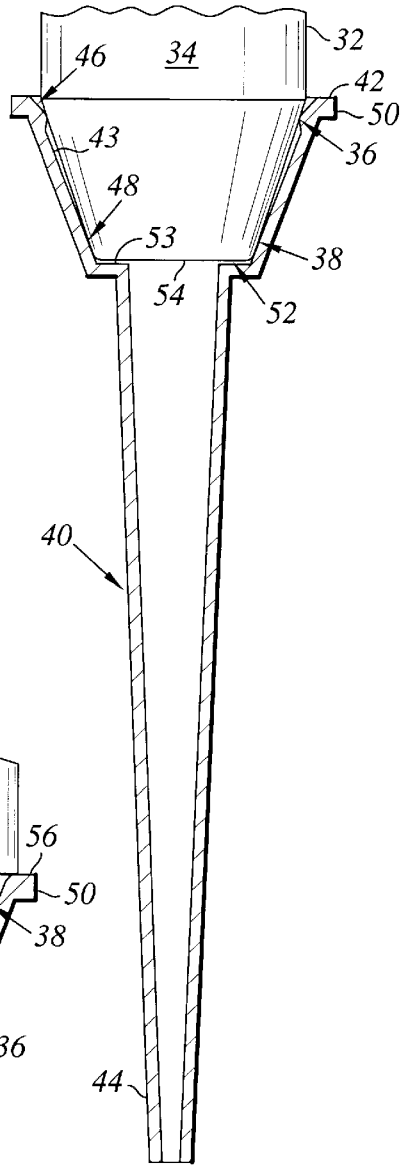
FIG. 7 resembles FIG. 2 and is a cross sectional side view of an embodiment of the pipette tip and mounting shaft combination of the present invention showing the fluid tight seal formed by an interference fit between the sealing region and sealing zone, a small interference fit between the lateral support region and zone and a preferred embodiment of the cooperative means including a shoulder on the pipette tip for limiting mounting shaft penetration into the tip.
Figure 8:
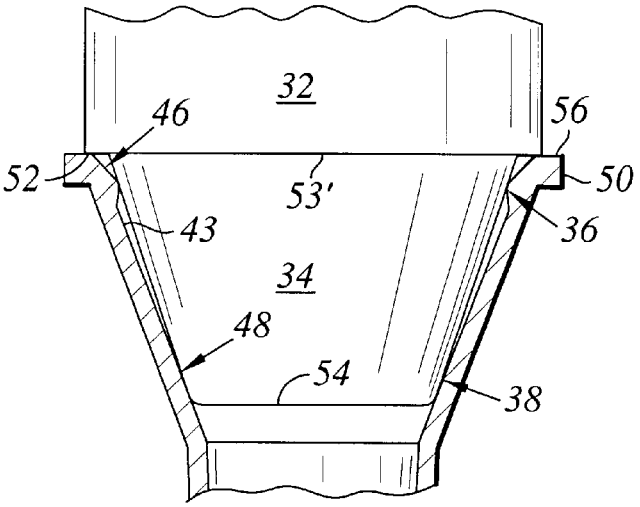
FIG. 8 is an enlarged fragmentary side view of an upper portion of the pipette tip and mounting shaft combination similar to FIG. 7 showing a first alternative embodiment of the cooperative means including a shoulder on the mounting shaft for limiting mounting shaft penetration into the tip.
Figure 9:
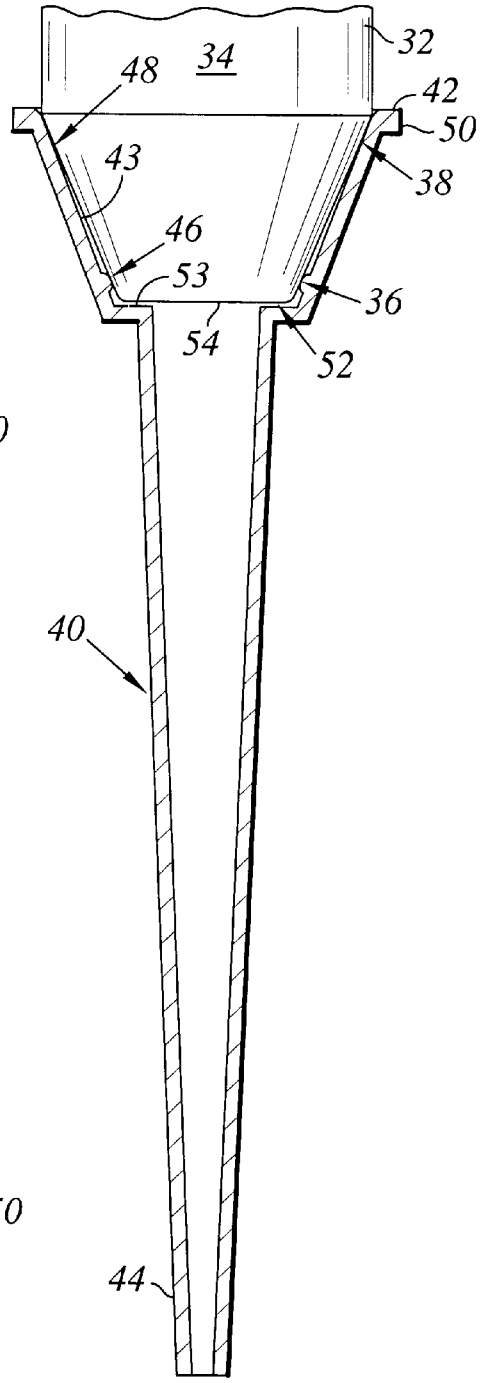
FIG. 9 resembles FIG. 7 and shows an embodiment where the axial location of the sealing zone and region is reversed relative to the axial location of the support zone and region shown in FIG. 7.
Figure 10:
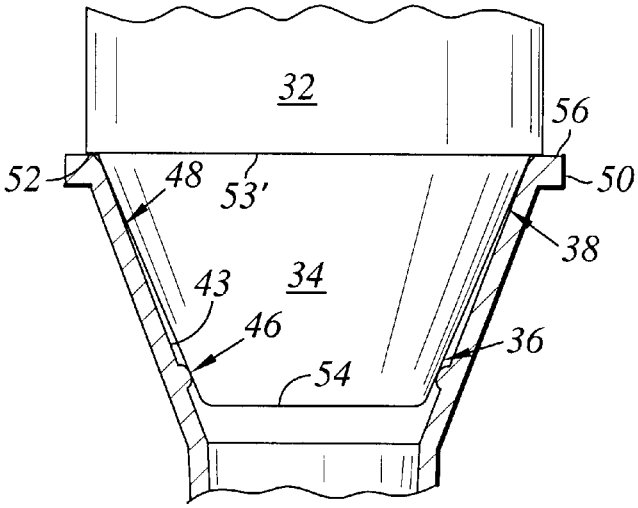
FIG. 10 resembles FIG. 8 and shows an embodiment where the axial location of the sealing zone and region is reversed relative to the axial location of the support zone and region shown in FIG. 8.

While in the foregoing, particular preferred embodiments of the pipette tip of the present invention have been described and illustrated in detail, changes and modifications may be made without departing from the spirit of the present invention. For example, FIGS. 5 and 6 show alternative embodiments of the combinations illustrated in FIGS. 2 and 4 respectively wherein the axial location of the sealing zone 36 and region 38 is reversed relative to the axial location of the support zone 46 and region 48 respectively.

For further example, FIGS. 7, 8, 9 and 10 resemble FIGS. 2, 4, 5 and 6 respectively and show alternative embodiments of the present invention where there is a small interference fit between the lateral support region 48 and support zone 38 to further enhance the lateral stability of the tip 40 on the shaft 32 without introducing an undesired increase in the axial forces required to mount and eject the tip from the shaft. In this regard, and as illustrated in each of FIGS. 7–10, it has been discovered that for pipette tip and shaft combinations wherein the interference fit between the sealing zone 36 and region 46 is about 0.075 mm to about 0.2 mm and the wall thickness of the pipette tip in the sealing region 46 and in the lateral support region 48 is between 0.2 and 0.5 mm, the lateral stability of the tip 40 on the shaft 32 can be further enhanced while maintaining the desired minimal tip mounting and ejection forces associated with the present invention when their is a small interference fit between the support region and zone. The small interference is provided by the lateral support region 48 of the tip 40 having an inner diameter which is slightly less than the outer diameter of the lateral support zone 38 of the shaft 32, eg. less than 0.075 mm. Further, when the shaft 32 and tip 40 are concentric and substantially circular in the support zone 38 and region 48, a secondary air tight seal may be created between the support zone and region without creating an undesired increase in the axial forces required to mount and eject the tip on and from the shaft.

Accordingly, the present invention is to be limited in scope only by the terms in the following claims.

What is claimed is:

1. An air displacement pipette comprising:

a pipette tip mounting shaft and a pipette tip including axially spaced and mating annular sealing and frusto-conical inwardly and downwardly tapering lateral support zones and regions, respectively, the annular sealing region comprising an annular sealing surface inward of a sidewall of the pipette tip which in the sealing region is sufficiently thin as to expand slightly to form an interference fit and air tight seal between the sealing surface and the sealing zone on the mounting shaft when the sealing zone penetrates the sealing region and the shaft having outer diameters within the inwardly and downwardly tapering lateral support zone which are slightly less than or substantially equal to corresponding uniform inner diameters within the axially tapering lateral support region thereby allowing some contact between the lateral support zone and regions without creating a secondary air tight seal; and means for insuring uniform depth of mounting shaft penetration into the pipette tip to maintain a uniform tip interference with the mounting shaft as successive tips are mounted on and ejected from the mounting shaft.

2. In an air displacement pipette, the combination comprising:

a pipette tip mounting shaft comprising an axially elongated body including a frusto-conical distal end portion having a frusto-conical outer surface having annular and axially spaced outer surface regions defining an annular sealing zone and an annular axially and inwardly tapering lateral support zone;

a pipette tip comprising an elongated tube comprising a frusto-conical open proximal end portion, an open conical distal end portion and annular and axially spaced inner surface regions on a frusto-conical inner surface of the proximal end portion defining an annular sealing region and an axially and inwardly tapering annular lateral support region for mating with the sealing zone and lateral support zone respectively, the sealing region comprising an annular sealing surface inward of a sidewall of the pipette tip and sufficiently thin in the sealing region as to expand slightly to form an interference fit and air tight seal between the sealing surface and the sealing zone on the mounting shaft when the sealing zone penetrates the sealing region and the shaft having outer diameters within the inwardly and downwardly tapering lateral support zone which are slightly less than or substantially equal to corresponding uniform inner diameters within the axially tapering lateral support region thereby allowing some contact between the lateral support zone and regions without creating a secondary air tight seal; and cooperative means on the pipette shaft and pipette tip for limiting the axial travel of the tip on the mounting shaft to insure uniform depth of mounting shaft penetration into the pipette tip to maintain uniform tip interference with the mounting shaft as successive tips are mounted on and ejected from the mounting shaft.

3. The combination of claim 2 wherein the cooperative means comprises an upwardly facing shoulder on an inner surface of the pipette tip for engaging a lower surface of the distal end of the pipette tip mounting shaft.

4. The combination of claim 2 wherein the cooperative means comprises a downwardly facing outwardly extending annular shoulder on the pipette tip mounting shaft for engaging a upwardly facing end of the pipette tip.

5. The combination of claim 2 wherein the annular sealing zone on the mounting shaft has an outer diameter slightly greater than an inner diameter of the annular sealing region on the pipette tip.

6. The combination of claim 5 wherein the sidewall has a thickness of between 0.2 and 0.5 mm.

7. The combination of claim 5 wherein the sealing region has an inner diameter which is at least 0.075 mm less that the outer diameter of the sealing zone.

8. The combination of claim 2 wherein the axial spacing of the sealing and support zones is substantially equal to the axial spacing of the sealing and support regions such that as the sealing zone penetrates the sealing region, the support region receives the support zone and provides lateral support therefor which prevents transverse rocking of the pipette tip on the mounting shaft as might otherwise occur during touching off of the pipette tip and an accompanying undesired dislodging of the tip from the shaft.

9. The combination of claim 2 wherein the axial spacing of the lateral support zone and region from the sealing zone and region is substantially equal to an inner diameter of the pipette tip in the support region.

10. The combination of claim 2 wherein the inner surface of the proximal end portion of the tip is substantially parallel to the outer surface of the distal end portion of the mounting shaft.

11. In an air displacement pipette, the combination comprising:

a pipette tip mounting shaft comprising an axially elongated body including a frusto-conical distal end portion having a frusto-conical outer surface having annular and axially spaced outer surface regions defining an annular sealing zone and an annular axially and inwardly tapering lateral support zone;

a pipette tip comprising an elongated tube comprising a frusto-conical open proximal end portion, an open conical distal end portion and annular and axially spaced inner surface regions on a frusto-conical inner surface of the proximal end portion defining an annular sealing region and an axially and inwardly tapering annular lateral support region for mating with the sealing zone and lateral support zone respectively, the sealing region comprising an annular sealing surface inward of a sidewall of the pipette tip having a wall thickness of between 0.2 and 0.5 mm in the sealing region so as to expand slightly to form an interference fit of about 0.075 mm to about 0.2 mm and an air tight seal between the sealing surface and the sealing zone on the mounting shaft when the sealing zone penetrates the sealing region and the shaft having outer diameters within the inwardly and downwardly tapering lateral support zone which are 0.075 mm or less greater than corresponding inner diameters within the axially tapering lateral support region where the wall thickness is between 0.2 and 0.5 mm, whereby the annular support region expands slightly to form an interference fit between the mounting shaft and the pipette tip when the support zone penetrates the support region; and cooperative means on the pipette shaft and pipette tip for limiting the axial travel of the tip on the mounting shaft to insure uniform depth of mounting shaft penetration into the pipette tip to maintain uniform tip interference with the mounting shaft as successive tips are mounted on and ejected from the mounting shaft.

* * * * *